US009897301B1

(12) United States Patent
Peng

(10) Patent No.: US 9,897,301 B1
(45) Date of Patent: Feb. 20, 2018

(54) E26 PLASTIC LAMPHOLDER

(71) Applicant: Rich Brand Industries Ltd., Dongguan, Guangdong (CN)

(72) Inventor: Te-Shui Peng, Taoyuan (TW)

(73) Assignee: Rich Brand Industries Ltd., Dongguan, Guangdong (CN)

( * ) Notice: Subject to any disclaimer, the term of this patent is extended or adjusted under 35 U.S.C. 154(b) by 0 days.

(21) Appl. No.: 15/698,354

(22) Filed: Sep. 7, 2017

Related U.S. Application Data

(63) Continuation-in-part of application No. 15/355,126, filed on Nov. 18, 2016, now Pat. No. 9,793,668.

(51) Int. Cl.

| | |
|---|---|
| ***H01K 1/46*** | (2006.01) |
| ***F21V 23/06*** | (2006.01) |
| ***H01R 33/22*** | (2006.01) |
| *F21S 8/02* | (2006.01) |

(52) U.S. Cl.
CPC ..... *F21V 23/06* (2013.01); *H01R 33/22* (2013.01); *F21S 8/02* (2013.01)

(58) Field of Classification Search
CPC ..... H01R 33/971; H01R 33/94; H01R 33/22; H01R 13/748; H01R 4/2404; H01K 1/465; H01K 1/46
USPC ..... 439/615, 306, 340; 362/412, 362
See application file for complete search history.

(56) References Cited

U.S. PATENT DOCUMENTS 5,569,044 A * 10/1996 Huang ..... H01R 33/22 439/340
5,702,267 A * 12/1997 Chen ..... F21V 21/002 439/340
5,702,268 A * 12/1997 Lien ..... H01R 4/2404 439/340
5,722,853 A * 3/1998 Hwang ..... F21V 21/002 439/340

* cited by examiner

*Primary Examiner* — Hien Vu
(74) *Attorney, Agent, or Firm* — Jen-Feng Lee, Esq.

(57) ABSTRACT

Present invention teaches the construction of an E26 lampholder primarily consisting of a housing, a plastic threaded ring, a plastic bracket, two electrode plates where the power lines entering into the internal accommodating space of the housing are connected to the two electrode plates, which provide the electrical connection points, instead of the full internal side walls being the electrical contact and the central point being the electrical contact, making the overall electrical contacts more solid and secure; the separate plastic bracket allows for more versatile options of the present E26 lampholder to be applied in wider possibilities of installation contexts.

3 Claims, 10 Drawing Sheets

E26 PLASTIC LAMPHOLDER

PRIORITY CLAIM

This is a Continuation-in-Part (CIP) under 37 C.F.R. § 1.53(b) of a prior application filed by the same inventor, application Ser. No. 15/355,126. Applicant hereby made the claim for the benefit of such earlier application under 37 C.F.R. § 1.78, including any domestic or foreign priority claimed by the prior application.

FIELD AND BACKGROUND OF THE INVENTION

The present invention relates to a lampholder, and more particularly to a plastic lampholder code-named E26 lampholder that can be manufactured, assembled and electrically connected more conveniently.

The invention of lighting devices improved all aspects of human activities. Without the invention of lighting devices (such as light bulbs) and a series of subsequent improvements and modifications, human beings cannot have such rapid advancement in all aspects of civilization.

The introduction of tungsten light bulbs was a great invention. It is generally known that over 90% of the electric energy consumed by a typical tungsten light bulb is converted into heat energy, and roughly only 10% of the electric energy is used for generating light. Obviously, the tungsten light bulbs have the drawbacks of high power consumption and low luminous efficiency. In recent years, government and private sectors of different countries in the world spare no effort to implement power saving and carbon reduction to maximize the utility of global resources and protect the environment. Particularly, in the aspect of illumination, various different power-saving fluorescent light bulbs and LED light bulbs have been developed to replace the traditional tungsten light bulbs.

In a home environment, there is a "downlight" generally installed as a lamp embedded into a sealed ceiling. The conventional tungsten light bulb is generally installed in the downlight and used for the purpose of illumination. Since the environment using the downlight is sealed and the tungsten light bulb generates much heat, the chance of burning the construction material such as the ceiling material becomes greater, and thus the downlight becomes a potential danger to the home environment. Consequently, the downlight light sources are being replaced by sources with lesser heat generation, such as fluorescent and LED lights.

The structure of a downlight is generally composed of a lamp body and a lampholder, wherein the lamp body is a shell object having an accommodating space formed therein. During assembly, the lamp body is embedded into an embedding hole formed on the ceiling to achieve the embedding and positioning effects. The bottom of the lamp body (that faces users) may be sealed by a cover or opened without having a cover, and the top of the lamp body is opened and slightly tapered to form an accommodating slot. The lampholder can be installed, fixed, and positioned into the accommodating slot, and the lampholder is provided for connecting a power line at the top and connecting a light bulb at the bottom. Therefore, the downlight can emit light downwardly from the light bulb, and then scatter downwardly in a range surrounding the lamp body to provide illumination. Since the lampholder of the downlight generally has a specification of E26, therefore such lampholder is called an E26 lampholder.

With reference for FIGS. 1 and 2 for a conventional lampholder 10 installed in a downlight, the conventional lampholder 10 is basically comprised of a housing 11, a metal bracket 12 and a metal threaded ring 13, wherein the housing 11 is made of a high temperature resistant ceramic material and formed into a cylindrical shape, and the top of the housing 11 is divided into positive and negative conductive lines 111 by a screwing or riveting means and the bottom of the housing 11 is opened inwardly; the metal bracket 12 is made of a flexible metal steel and divided into a roof portion 121 and two elastic board parts 122 disposed on both sides of the metal bracket 12 respectively, and the roof portion 121 is fixed to the top of the housing 11 (by the screwing or riveting means) for the assembling, so that the two elastic board parts 122 are extended slantingly outwardly from both sides of the housing 11 (as shown FIG. 1); the metal threaded ring 13 is installed from the bottom of the housing 11 and coupled to the conductive line 111 of one of the electrode (negative electrode) of the metal threaded ring 13, so that 5 the conductive line 111, the housing 11 and the metal threaded ring 13 are fixed to one another through the aforementioned screwing or riveting means, and the conductive line 111 of the other electrode (positive electrode) is coupled to a cathode conductive plate 112 by the screwing or riveting means (as shown in FIG. 1), and the cathode conductive plate 112 is independently situated within an open range at the top of the metal threaded ring 13.

After the downlight is assembled, the lampholder 10 is installed and positioned in the accommodating slot at the top of the lamp body of a downlight, so that the elastic board parts 122 disposed on both sides of the metal bracket 12 is latched to the wall of the accommodating slot at the top of the lamp body, so as to achieve the effect of securely fixing the lampholder 10 to the accommodating slot at the top the lamp body. When the whole downlight is installed to the ceiling, the lamp body of the downlight is embedded into the embedding hole formed on the ceiling, and the downlight is secured installed to the embedding hole by a latching means; then the conductive lines 111 are electrically connected and conducted with two electrodes of a power line connected to the main power, so that a switch on the wall which is connected to the power lines may be used to control and turn on/off the power supply; and finally the light bulb is installed by extending the light bulb from the bottom of the lamp body, and a threaded joint screw of the light bulb is installed and secured into the metal threaded ring 13 of the lampholder 10. Now, the top of the threaded joint screw of the light bulb abuts against the cathode conductive plate 112 to electrically conduct the conductive line 111 of the positive electrode, and the threaded portion of the threaded joint screw of the light bulb is electrically conducted with the conductive line 111 of the negative electrode through the metal threaded ring 13.

In summary, the conventional lampholder 10 has the following drawbacks and requires improvements.

1. The conventional lampholder 10 must have the positive and negative conductive lines 111 connected to the top of the housing 11 by a screwing or riveting means, and the conductive lines 111 are electrically conducted with the electrodes of the power line of the main power respectively, and such structure and connection method are complicated.
2. In the design of the conventional lampholder 10, the roof portion 121 of the metal bracket 12 and the top of the housing 11 are fixed by a screwing or riveting means, and such structure and connection method are also complicated.
3. In the design of the conventional lampholder 10, the metal threaded ring 13 and the housing 11 are connected, and then the metal threaded ring 13 carries the threaded joint screw of the light bulb, and such structure and connection method are also complicated.

SUMMARY OF THE INVENTION

The invention relates to an improved lampholder apparatus for the industrial E26 downlight specification, where the electrical connection is made to use less amount of metal and the electrical connection is just as solid, if not more solid.

Present lampholder primarily consisting of a housing, a plastic threaded ring, a plastic bracket, two electrode plates where the power lines entering into the internal accommodating space of the housing are connected to the two electrode plates, making the overall electrical contacts more solid and secure. The design of the separate plastic bracket allows for more versatile options of the present E26 lampholder to be applied in wider possibilities of installation contexts.

A primary objective of the present invention is to provide an E26 plastic lampholder that can be connected to a power supply more conveniently for its use on a downlight.

Another objective of the present invention is to provide an E26 plastic lampholder that makes the assembling and operation of a housing and a plastic bracket more conveniently for its use on a downlight.

A further objective of the present invention is to provide an E26 plastic lampholder wherein a plastic threaded ring is directly and integrally formed with a housing to facilitate the manufacturing and assembling process for its use on a downlight.

To achieve the aforementioned and other objectives, the present invention discloses an E26 plastic lampholder comprising a housing, a plastic bracket, a plastic threaded ring, a positive electrode plate and a negative electrode plate, wherein the housing is made of a plastic material and has an opening inwardly to form an accommodating space, two latch slots symmetrically formed at the inner top of the housing, two wire plug slots formed on both sides of the top of the housing respectively and communicated with the two latch slot respectively, and a vertical shallow groove concavely formed on an internal wall of the housing; the plastic bracket is made of a plastic material and comprises a horizontal roof portion and two elastic board parts extended towards both sides, and the roof portion is coupled to the top of the housing, so that the two elastic board parts are slantingly extended to both sides of the housing respectively; the plastic threaded ring is a threaded notch integrally formed on an internal wall of the housing and the plastic threaded ring breaks its extension at the shallow groove and recurs after crossing the shallow groove.

The positive electrode plate is made of an electrically conductive material and has a conductive protruding portion which makes an arc turn of substantially 180° after extending for a small section and then bends upwardly to form a vertical wall after extending for a small section, and a stop plate is stamped on the vertical wall, and an upper end of the vertical wall is turned in the opposite direction and extended to form an slantingly installed electric connection plate, and a latch recess is stamped at the front end of the electric connection plate, and the positive electrode plate is accommodated in the accommodating space of the housing, so that the electric connection plate and the vertical wall enter into one of the latch slots, and the latch recess of the electric connection plate is aligned precisely with one of the wire plug slots, and the stop plate on the vertical wall abuts against the latch slot wall to stop and position the positive electrode plate, while the conductive protruding portion on the positive electrode plate is extended to the center of an upper portion of the accommodating space; the negative electrode plate is made of an electrically conductive material and has a conductive bent portion which is bent and extended for a small section after being stretched upwardly, and then further bent upwardly to form a vertical wall, and a stop plate is stamped on the vertical wall of the negative electrode plate, and an upper end of the vertical wall of the negative electrode plate is then turned in the opposite direction and extended to form a slantingly installed electric connection plate, and a latch recess is stamped from a front end of the electric connection plate of the negative electrode plate, and the negative electrode plate is accommodated in the accommodating space of the housing, so that the electric connection plate of the negative electrode plate and the vertical wall enter into another latch slot, and the latch recess on the electric connection plate of the negative electrode plate is aligned precisely with the other wire plug slot, and the stop plate on the vertical wall of the negative electrode plate abuts against the latch slot wall to stop and position the negative electrode plate while a plate disposed on the negative electrode plate and at a position where the conductive bent portion is disposed extends downwardly and stays in the shallow groove of the housing.

In the E26 plastic lampholder, the housing has a horizontal combining groove formed in the middle of the top of the housing and a combining slot formed near the top of the center of the housing, and the plastic bracket has a combining perforation formed at the center of the plastic bracket, and the roof portion of the plastic bracket is contained in the combining groove of the housing, so that the combining perforation of the plastic bracket is aligned precisely with the combining slot of the housing, and an engaging member is passed through the combining perforation and the combining slot to couple the plastic bracket with the housing. In the E26 plastic lampholder, the housing, the plastic bracket and the plastic threaded ring are made of a plastic material and integrally formed.

DESCRIPTION OF THE DRAWINGS

The accompanying drawings, which are incorporated in and constitute a part of this specification, illustrate the preferred embodiments of the invention and together with the description, serve to explain the principles of the invention.

DETAILED DESCRIPTION OF THE PREFERRED EMBODIMENT

Figure 1:
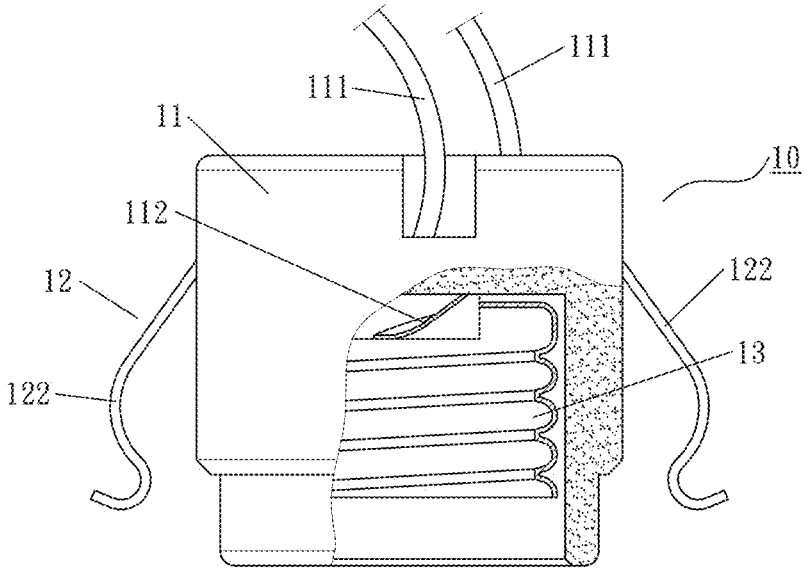
FIG. 1 (PRIOR ART)
FIG. 1 is a partial sectional side view of a conventional lampholder.
Figure 2:
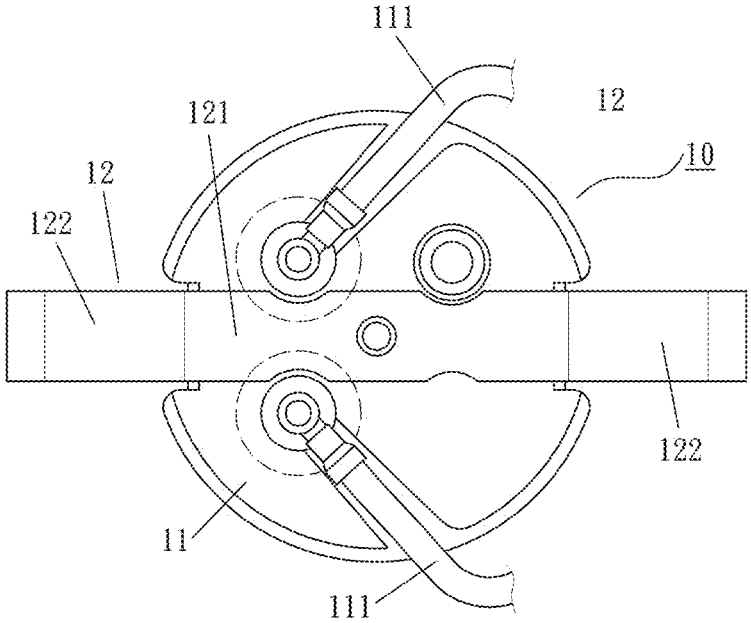
FIG. 2 (PRIOR ART)
FIG. 2 is a top view of a conventional lampholder.
Figure 3:
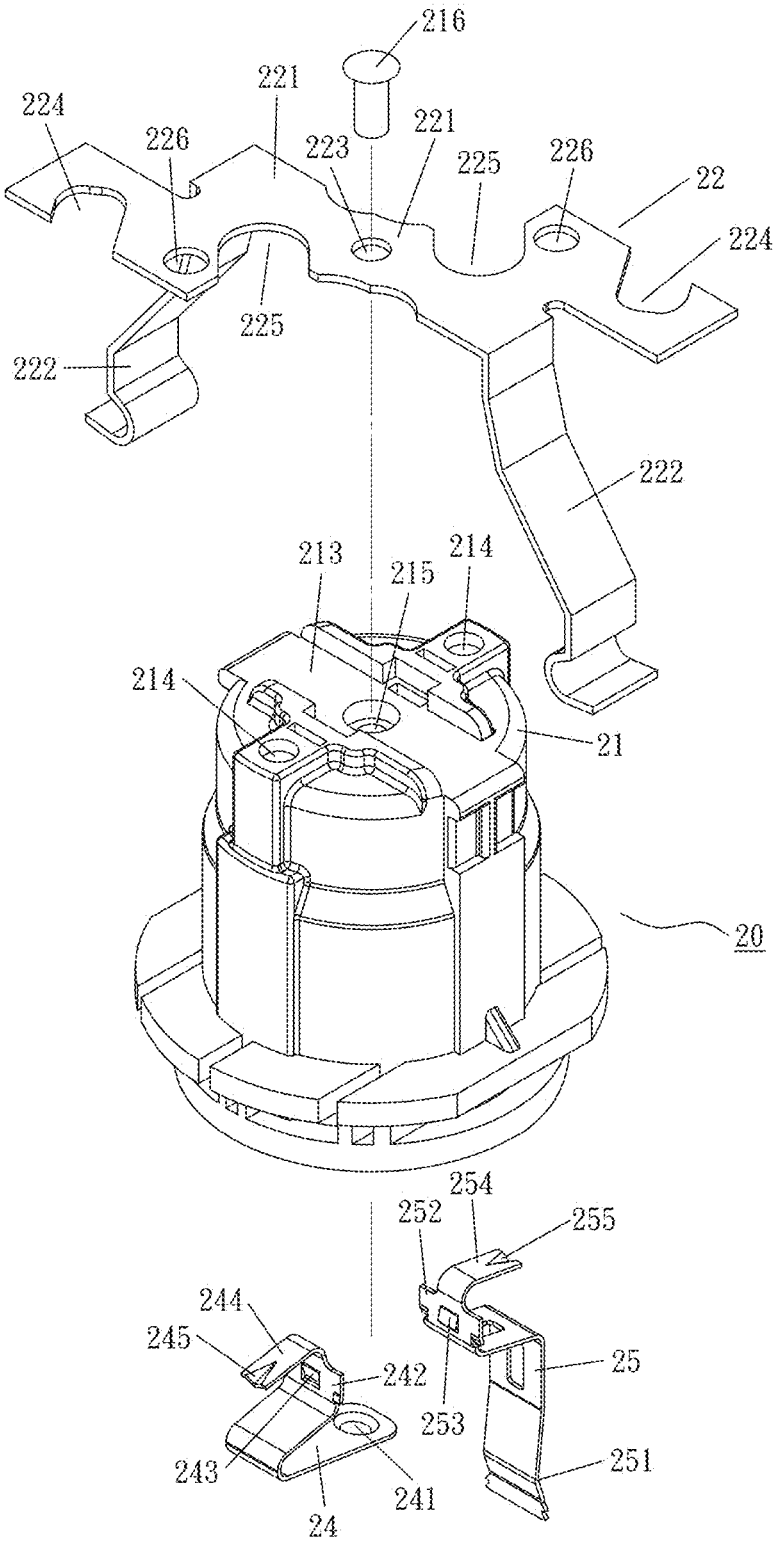
FIG. 3 is an exploded view of an embodiment of the present invention viewing from the top.

The technical characteristics, contents, advantages and effects of the present invention will be apparent with the detailed description of a preferred embodiment accompanied with related drawings as follows.

With reference to FIGS. 3 to 6 for an E26 plastic lampholder 20 of an embodiment of the present invention, the E26 plastic lampholder 20 comprises a housing 21, a plastic bracket 22, a plastic threaded ring 23, a positive electrode plate 24 and a negative electrode plate 25.

Figure 13A:
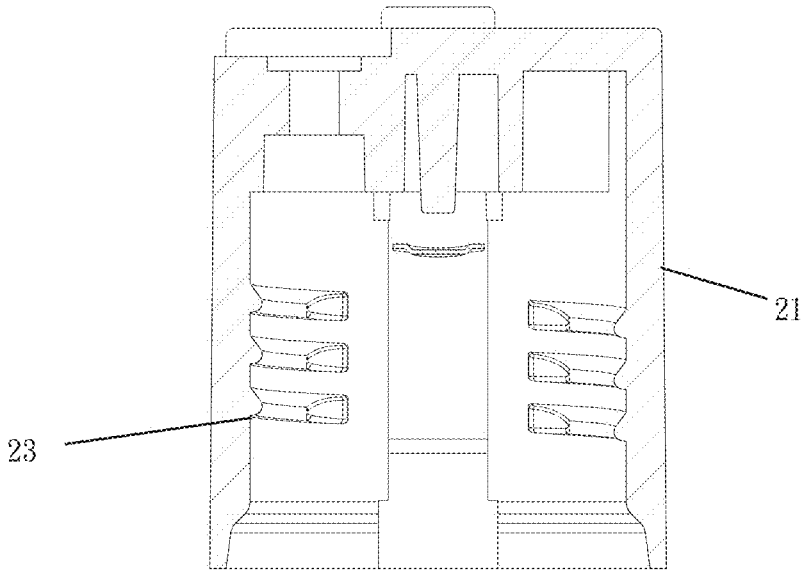
FIGS. 13*a* and 13*b* show the sectional side views of the present invention where the u-bent portions of the positive/negative electrode plates are snugly fitted into the respective latch slots.

FIG. 13*a* shows a simplified view of the housing without the bracket 22 or the electrode plates 24/25.

Figure 4:
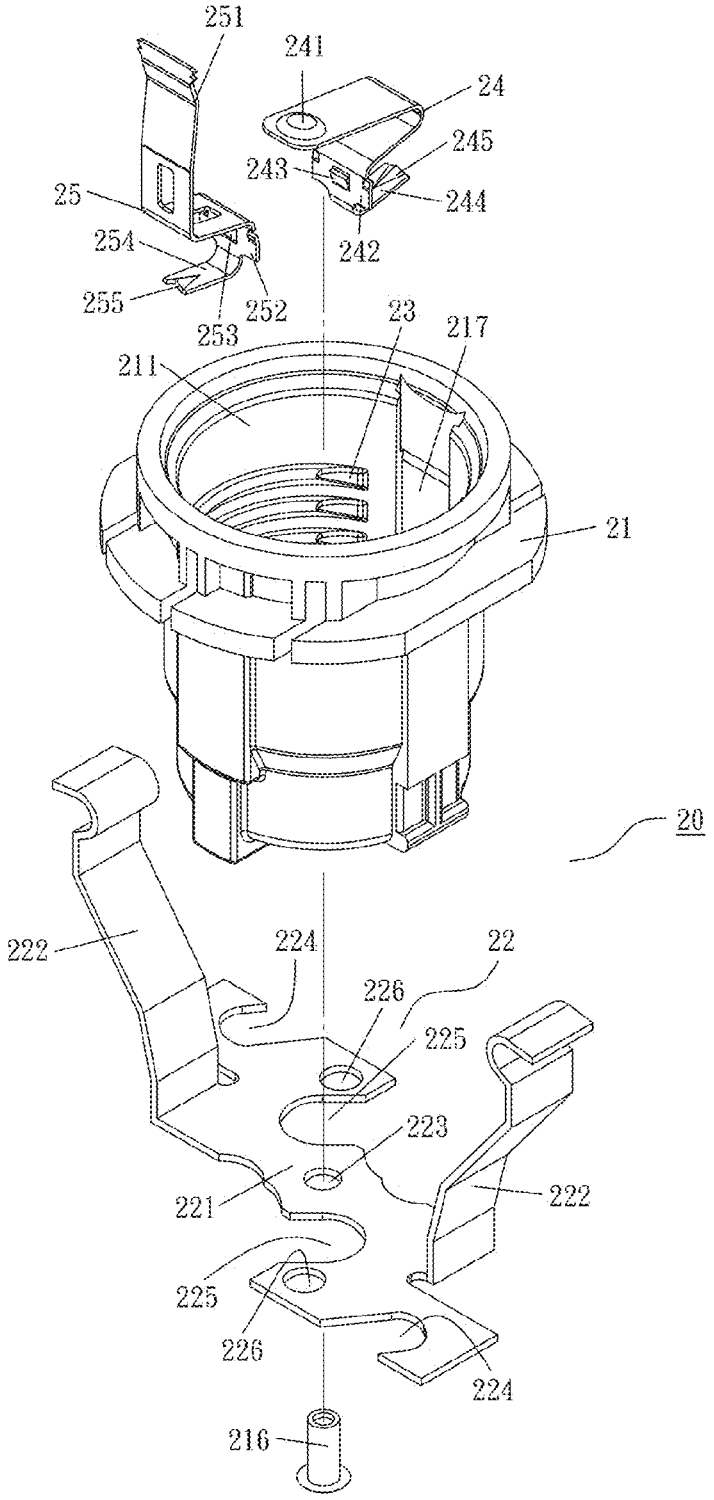
FIG. 4 is an exploded view of an embodiment of the present invention viewing from the bottom.
Figure 6:
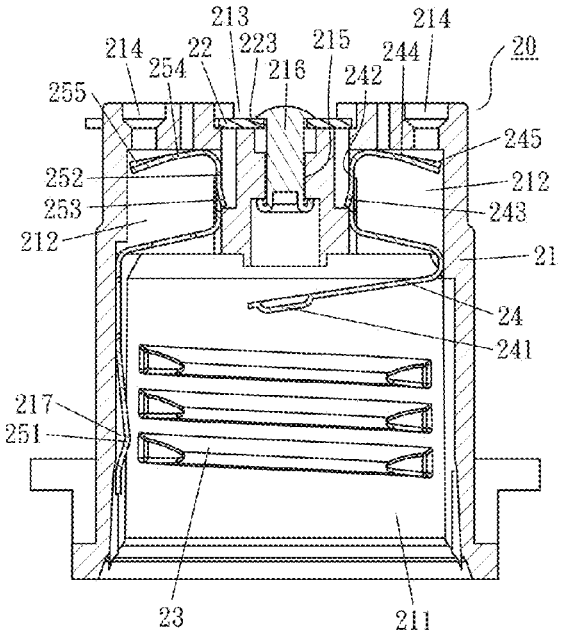
FIG. 6 is a sectional side view of an embodiment of the present invention.
Figure 7:
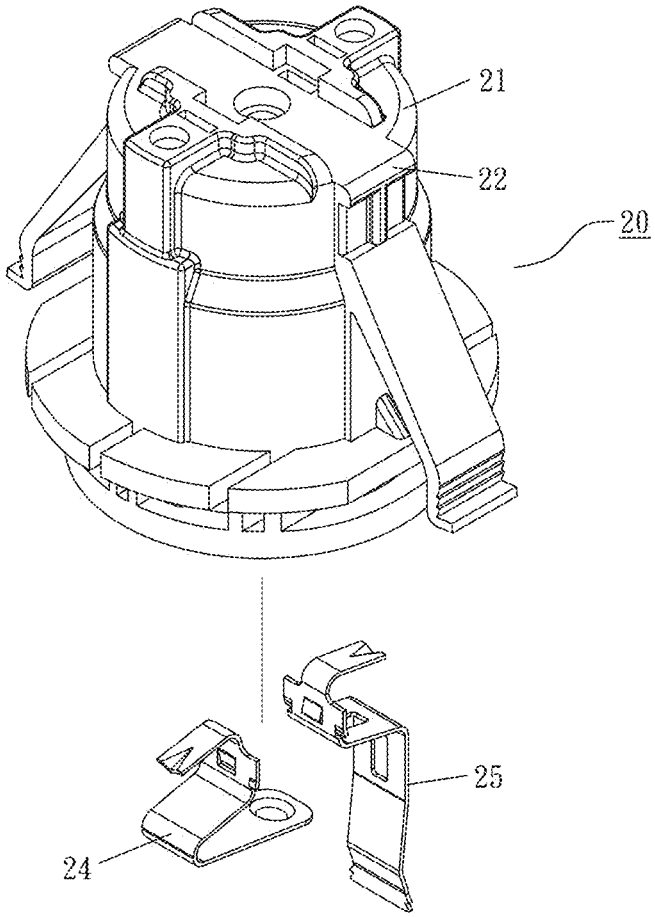
FIG. 7 is a perspective view of an embodiment of the present invention with the two electrode plates outside of the housing.
Figure 8:
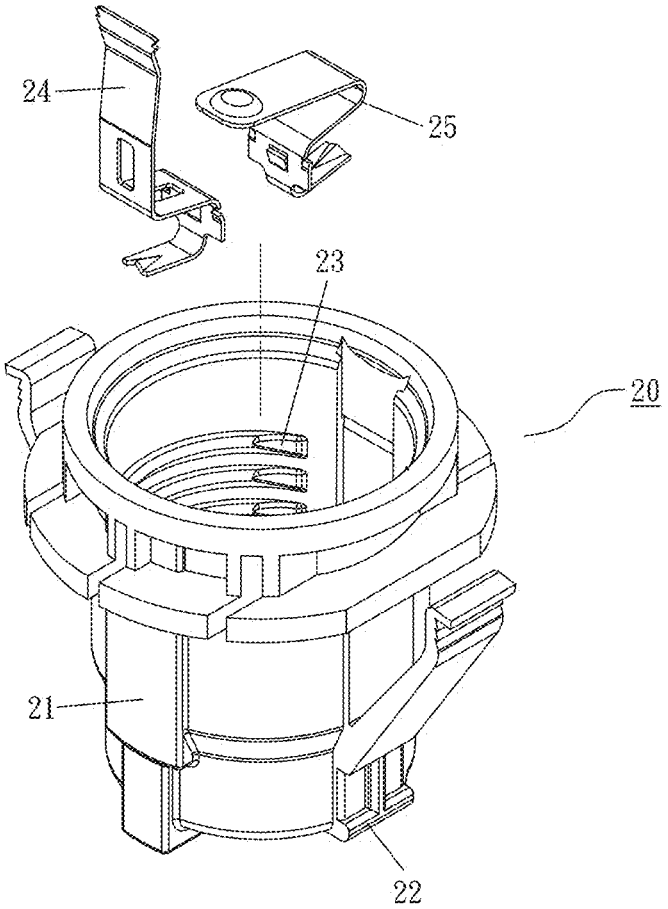
FIG. 8 is a perspective view of present invention viewing from the bottom.
Figure 9:
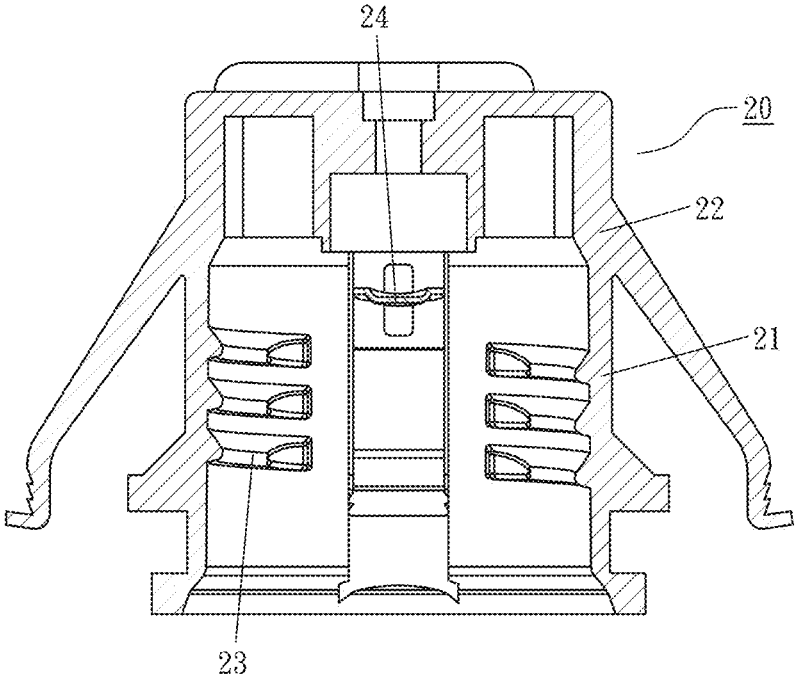
FIG. 9 is a sectional front view of an embodiment of the present invention.

The housing 21 is made of a plastic material and has an opening inwardly to form an accommodating space 211 and two latch slots 212 symmetrically formed at the inner top of the housing 21 (as shown in FIG. 6), and the top of the housing 21 is a solid wall, and a horizontal combining groove 213 is formed at the middle of the housing 21, and a combining slot 215 is formed near the top the housing, at substantially equal distance to the two wire plug slots 214 respectively and disposed at the center of the housing 21, and the combining slot 215 is provided, allowing for passing and installing a respective engaging member 216 (such as a screw or a rivet), and the wire plug slots 214 are configured and communicated with a respective latch slot 212 separately. In other words, each wire plug slot 214 is interconnected to a latch slot 212, and a vertical shallow groove 217 is concavely formed on an internal wall of the housing 21 (as shown in FIGS. 4 and 6). The plastic bracket 22 is made of a plastic material and has a horizontal roof portion 221, two elastic board parts 222 extended to both sides of the plastic bracket 22 respectively and a combining perforation 223 disposed at the center of the plastic bracket 22. The combining perforation 223 is configured to be corresponsive to the combining slot 215 and an engaging member 216. The plastic bracket 22 further comprises components including a pair of hook slots 224, a pair of circular hook notches 225 and a pair of connecting holes 226 disposed on the roof portion 221 and symmetrically around the center combining perforation 223. The plastic threaded ring 23 is a deep threaded notch formed on an internal wall of the housing 21 and integrally formed with the housing 21. However, the plastic threaded ring 23 is not formed at a position of the internal wall of the housing 21 where the shallow groove 217 is formed (as shown in FIGS. 4 and 6). In other words, the plastic threaded ring 23 breaks its extension at the position where the shallow groove 217 is situated and recurs after passing through the shallow groove 217.

The positive electrode plate 24 is made of an electrically conductive material and has a conductive protruding portion 241 and makes an arc turn with an angle substantially equal to (or smaller than) 180° after being extended for a small section and then bent upwardly to form a vertical wall 242 after being extended for a small section, and a stop plate 243 is stamped on the vertical wall 242, and an upper end of the vertical wall 242 is turned in an opposite direction and extended to form a slantingly installed electric connection plate 244, and a latch recess 245 is stamped and formed at the front end of the vertical wall 242.

Figure 11:
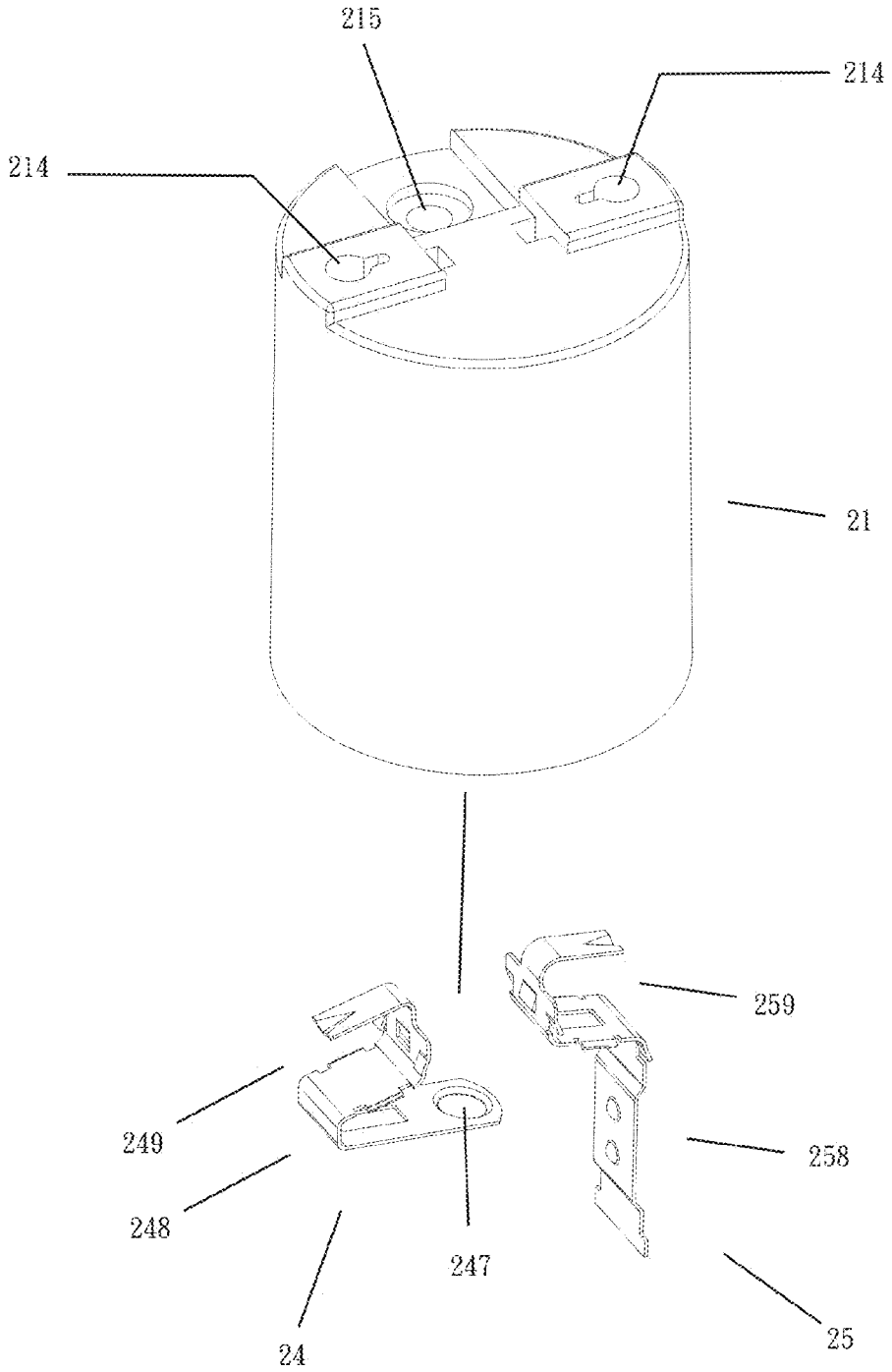
FIG. 11 is a perspective view of an embodiment of the present invention without the pastic bracket.
Figure 12:
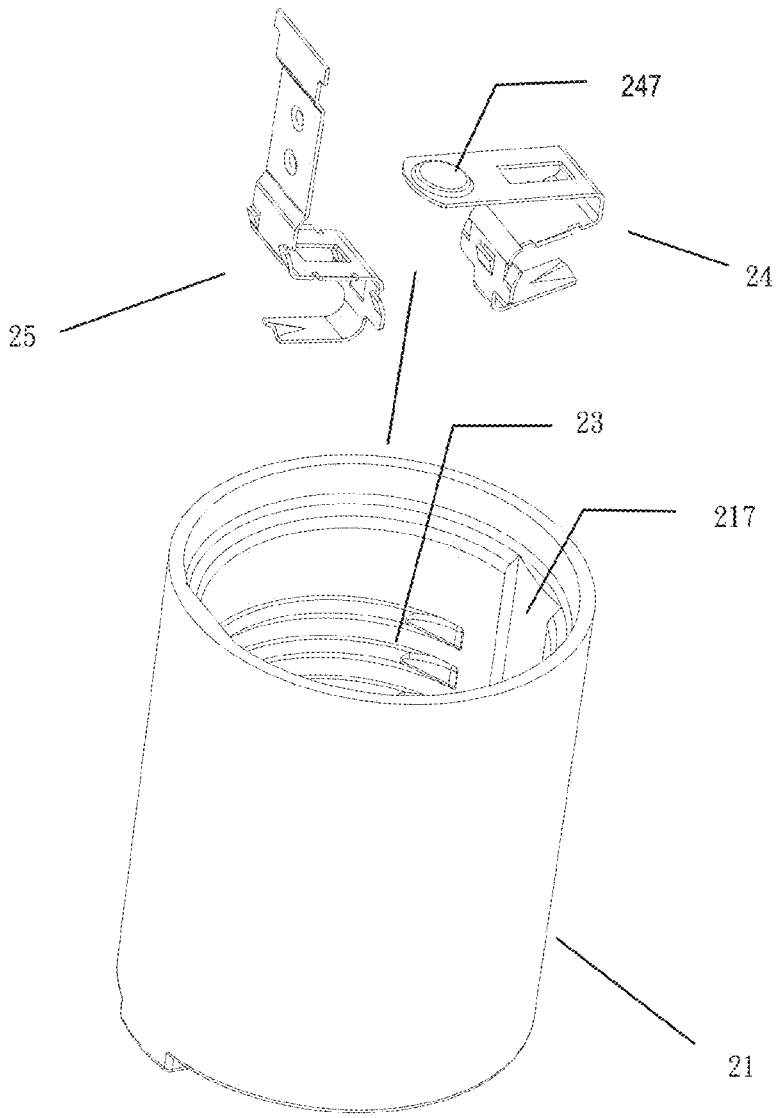
FIG. 12 is a perspective view of the inside of the housing with two electrode plates disassembled from the housing.

The positive electrode plate 24, in a top-down orientation as depicted in FIG. 6 is also characterized, as shown in FIG. 11, by a u-bent portion 249 and an extended bent-back portion 248 containing an end conductive tip 247. The conductive tip 247 can be implemented to have a hole, or a small raised bump, or simply a flat surface, depending on application needs or preferences, as shown in FIG. 12.

The negative electrode plate 25 is made of an electrically conductive material and has a conductive bent portion 251 which is bent inwardly for a small section after being stretched upwardly, and then bent upwardly to form a vertical wall 252, and a stop plate 253 is stamped and formed on the vertical wall 252, and an upper end of the vertical wall 252 is turned in an opposite direction and extended to form a slantingly installed electric connection plate 254, and a latch recess 255 is stamped and formed at a front end of the vertical wall 252.

Figure 13B:
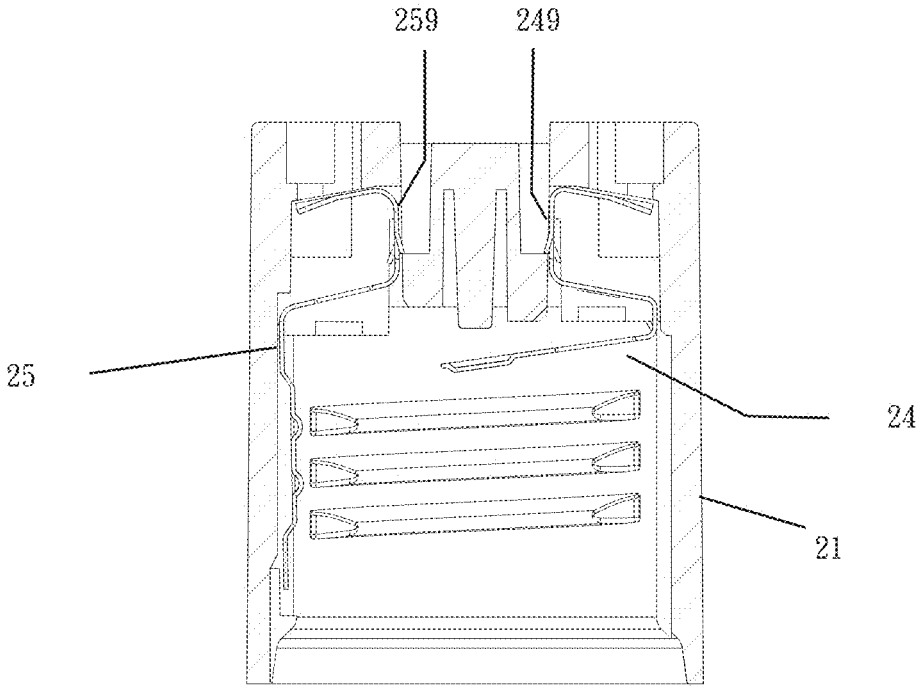

The negative electrode plate 25, in a top-down orientation as depicted in FIG. 6 is also characterized by a u-bent portion 259 and an extended conductive bent portion 258, as shown in FIG. 13*b*.

Figure 5:
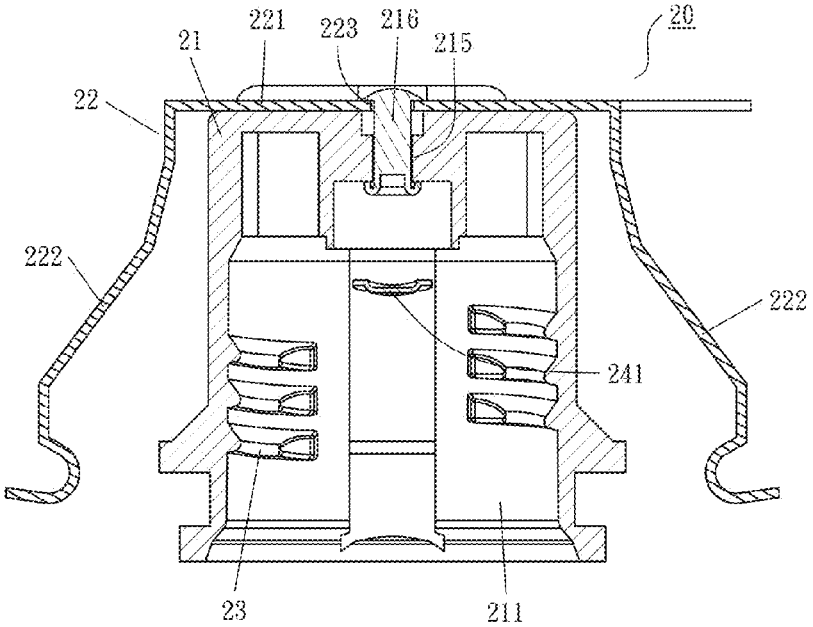
FIG. 5 is a sectional front view of an embodiment of the present invention.

During assembling, the roof portion 221 of the plastic bracket 22 is accommodated and positioned in the combining groove 213 of the housing 21. Now, the combining perforation 223 of the plastic bracket 22 is aligned precisely with the combining slot 215 of the housing 21, so that an engaging member 216 (such as a screw or rivet) may be passed through the combining perforation 223 and the combining slot 215 and a force may be applied for the connection, so as to rely connect the plastic bracket 22 with the housing 21. Now, the two elastic board parts 222 of the plastic bracket 22 are externally and slantingly extended to both sides of the housing 21 (as shown in FIG. 5).

The positive electrode plate 24 is installed and accommodated in the accommodating space 211 of the housing 21, and the electric connection plate 244 and the vertical wall 242 enter into one of the latch slots 212. Now, the latch recess 245 of the electric connection plate 244 is aligned precisely with one of the wire plug slots 214, and the stop plate 243 of the vertical wall 242 abuts at a recess formed on the wall of the latch slot 212 to stop the positive electrode plate 24 from separating in a downward direction.

Figure 10:
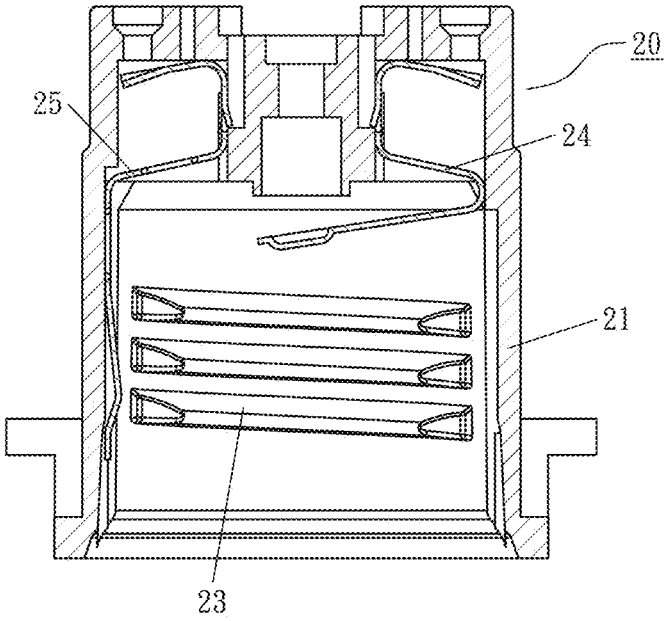
FIG. 10 is a sectional side view of an embodiment of the present invention.

In the meantime, the conductive protruding portion 241 on the positive electrode plate 24 is extended to the center of the top of the accommodating space 211. The negative electrode plate 25 is installed and accommodated in the accommodating space 211 of the housing 21, and the electric connection plate 254 and the vertical wall 252 enter into the other latch slot 212. Now, the latch recess 255 of the electric connection plate 254 is aligned precisely with another wire plug slot 214, and the stop plate 253 on the vertical wall 252 abuts at a recess formed on a wall of the latch slot 212 to stop the negative electrode plate 25 form separating in a downward direction. In the meantime, the plate with the conductive bent portion 251 of the 10 negative electrode plate 25 extends downwardly and stays in the shallow groove 217 of the housing 21 (as shown in FIGS. 6, 10, and 13*b*).

The u-bent portion 249 of the positive electrode plate 24 and the u-bent portion 259 of the negative electrode plate 25 are each placed snugly inside one of the two latch slots 212 of the accommodating space 211, as shown in FIG. 6 and FIG. 13*b*. The extended conductive bent portion 258 of the negative electrode plate 25 extends downwardly and stays in the vertical shallow groove 217 of the housing 21; and the end conductive tip 247 of the extended bent-back portion 248 of the positive electrode plate 24 stays in the center area of the accommodating space 211.

When the E26 plastic lampholder 20 is assembled into the accommodating slot at the top of the lamp body of a downlight, the elastic board parts 222 disposed on both sides of the plastic bracket 22 are extended outwardly and coupled to a wall of the accommodating slot formed at the top of the lamp body, so that the E26 plastic lampholder 20 is secured to the accommodating slot formed at the top of the lamp body. However, the assembling environment of an actual installation varies in different cases, so that components such as a hook slot 224, a circular hook notch 225 and/or a connecting hole 226 may be applied to the plastic bracket 22 to facilitate the assembling or provide a more secured installation.

After the E26 plastic lampholder 20 is assembled with the lamp body to form a downlight, the whole downlight may be installed to a ceiling for use. The hard bare line sections of the two electrodes of a power line connected to the main power may be plugged into the wire plug slots 214 respectively, and the bare line sections of the two electrodes of the power line touch the latch recess 245 of the positive electrode plate 24 and the latch recess 255 of the negative electrode plate 25 respectively, and then a force may be apply to press the bare line sections of the two electrodes of the power line into the wire plug slots 214 further, and the two bare line sections will press the electric connection plate 244 of the positive electrode plate 24 and the electric connection plate 254 of the negative electrode plate 25 to bent inwardly, so that the two bare line sections are in contact and scratch through the latch recesses 245, 255 to enter into the latch slots 212, as shown FIGS. 3 & 4. When the force is released, the resilience of the electric connection plates 244, 254 drives the latch recesses 245, 255 together with the walls of the latch slots 212 to clamp the two bare line sections securely, so that the electrodes of the power line connected to the mains power are electrically conducted with the positive electrode plate 24 and the negative electrode plate 25, and the threaded joint screw of the light bulb of the cold light illumination series (such as a power saving fluorescent light bulb or an LED light bulb) enters into the plastic threaded ring 23 until the top of the threaded joint reaches deeply into the conductive protruding portion 241 of the positive electrode plate 24, so that the top of the threaded joint is electrically conducted with the positive electrode plate 24. In the meantime, the threaded portion of the threaded joint is electrically conducted with the plastic threaded ring 23 and the conductive bent portion 251 of the negative electrode plate 25, so that the power saving fluorescent light bulb or the LED light bulb will be lit.

With reference to FIGS. 7 to 10 for another embodiment of the present invention, the housing 21, the plastic bracket 22 and the plastic threaded ring 23 of the E26 plastic lampholder 20 are made of a plastic material and integrally formed by the same manufacturing principles and effects, and then the positive electrode plate 24 and the negative electrode plate 25 are installed to complete the assembling of the E26 plastic lampholder 20. Therefore, the step of assembling the housing 21 and the plastic bracket 22 can be skipped. The positive electrode plate 24 and the negative electrode plate 25 can be assembled directly according to the aforementioned assembling process. In summation of the description above, the E26 plastic lampholder 20 of the present invention can be assembled and used easily, since the two electrodes of the power line can be plugged into the wire plug slots 214 through the bare line sections. Therefore, the E26 plastic lampholder 20 can be installed without requiring any screw or rivet. Particularly, the plastic bracket 22 and the housing 21 are made of a plastic material, so that the manufacture is simpler and easier, and the combining groove 213 reserved on the housing 21, is provided for accommodating and positioning the plastic bracket 22, or the housing 21, the plastic bracket 22 and the plastic threaded ring 23 are integrally formed to make the assembling and operating processes more conveniently. In addition, the plastic threaded ring 23 may be directly and integrally formed into the housing 21 to make the manufacturing and assembling processes more conveniently.

While the invention has been described by means of specific embodiments, numerous modifications and variations could be made thereto by those skilled in the art without departing from the scope and spirit of the invention set forth in the claims.

The invention claimed is:

1. An E26 plastic lampholder, comprising:

a plastic housing;

a plastic threaded ring; and a positive electrode plate and a negative electrode plate;

wherein the housing has an opening inwardly to form an accommodating space, two wire plug slots formed in a top surface of the housing respectively, and a vertical shallow groove formed on an internal wall of the housing;

wherein the plastic threaded ring is threaded notches integrally formed on an internal wall of the housing and the plastic threaded notches breaks their extensions at substantially both sides of the vertical shallow groove;

wherein said positive electrode plate is formed with a u-bent portion and an extended bent-back portion containing an end conductive tip; said negative electrode plate is formed with a u-bent portion and an extended conductive bent portion;

wherein the extended conductive bent portion of the negative electrode plate extends downwardly and stays in the vertical shallow groove of the housing and the end conductive tip of the extended bent-back portion of the positive electrode plate stays in a center area of the accommodating space;

wherein the plastic housing further having two latch slots symmetrically formed at the inner top of the housing, said latch slots are sized to snugly receive in place the u-bent portions of the positive and negative electrode plates respectively; and wherein the lampholder further comprising a plastic bracket, said plastic bracket is formed with a roof portion and two elastic board parts extended towards both sides, and the roof portion is coupled to the top of the housing, so that the two elastic board parts are slantingly extended to both sides of the housing respectively.

2. The lampholder of claim 1, wherein the plastic bracket further comprises a combining perforation at the center of the bracket, and a pair of hook slots, a pair of circular hook notches and a pair of connecting holes disposed on the roof portion and symmetrically around the center combining perforation.

3. The lampholder of claim 2, wherein the housing has a horizontal combining groove in the middle of the top of the housing and a combining slot formed near the center of the housing, and the roof portion of the plastic bracket is coupled to the combining groove of the housing, so that the combining perforation of the plastic bracket is aligned precisely with the combining slot of the housing, and an engaging member is passed through the combining perforation and the combining slot to secure the plastic bracket with the plastic housing.

* * * * *